US005114393A

United States Patent [19]

Vettorato

[11] Patent Number: 5,114,393

[45] Date of Patent: May 19, 1992

[54] METHOD AND APPARATUS FOR MANUFACTURING SACKS, AND SACKS OBTAINED THEREBY

[75] Inventor: Natale Vettorato, Minerbio, Italy

[73] Assignee: B.L. Macchine Automatiche S.r.l., Italy

[21] Appl. No.: 547,843

[22] Filed: Jun. 13, 1990

[51] Int. Cl.[5] ..... B31B 49/00

[52] U.S. Cl. ..... 493/193; 493/248; 493/381

[58] Field of Search ..... 493/189, 190, 193, 194, 493/195, 196, 198, 243, 248, 251-253, 297, 298, 346, 380, 381; 53/553, 554, 555

[56] References Cited

U.S. PATENT DOCUMENTS

| | | | |
|---|---|---|---|
| 2,440,664 | 4/1948 | Irons . | |
| 3,155,017 | 11/1964 | Haslacher | 493/189 |
| 3,473,725 | 10/1969 | Wiehahn | 493/189 X |
| 3,827,341 | 8/1974 | Stage | 493/210 X |
| 4,016,026 | 4/1977 | Grevich | 493/189 X |
| 4,871,347 | 10/1989 | Brinkmeier | 493/248 X |
| 4,915,679 | 4/1990 | Gotou | 493/381 X |

FOREIGN PATENT DOCUMENTS 3721303 1/1989 Fed. Rep. of Germany .

*Primary Examiner*—William E. Terrell
*Assistant Examiner*—John A. Marlott
*Attorney, Agent, or Firm*—Larson and Taylor

[57] ABSTRACT

A method and apparatus for manufacturing sacks, made of polyethylene or other heat-sealable material, obtained by superposing two films or sheets which are unwound from respective rolls and are submitted to a pair of longitudinal welds to form a tube, and to transverse welds cuts. The edges of one of the sheets are formed with a re-entrant fold whereby the edges will overlap, with a portion of their outer faces, corresponding portions of the inner face of the other sheet. When only one of the sheets is folded at the edges, the welding of the overlapped end portions is effected by a single respective sealing bar acting on the outer face of the edges to be joined and having an opposite stationary contrasting member. In order to concentrate the welding heat only on the edge portions to be secured to each other, and to prevent said heat from reaching the sheet whose edges have been folded and acted upon by the stationary contrasting member, an insert strip of any suitable material, sufficiently flexible and of such a length as to extend over the entire length of the sealing bars, is inserted between the parts of the edge portions.

3 Claims, 3 Drawing Sheets

METHOD AND APPARATUS FOR MANUFACTURING SACKS, AND SACKS OBTAINED THEREBY

BACKGROUND OF THE INVENTION

Methods and apparatuses are known for manufacturing sacks made of polyethylene or other heat-weldable material, starting from two sheets, unwound from respective rolls, which are superposed on each other and are conveyed with a longitudinal movement, along a vertical path of travel along which they are held at their longitudinal edges by pairs of superposed chains which are synchronized with each other so as to transport downwards the tube formed by the two sheets. Stationary guides control the active runs of the chains to firmly clamp the edges of the sheets. Usually, said chains are advanced intermittently, and during the dwell period the superposed portions of the two sheets, which are disposed outside of the chains, will be engaged by pairs of rectilinear, parallel and opposite welders which effect longitudinal and continuous heat-welds on said sheets so that a continuous tube exits from the lower portion of the pairs of chains and is then closed by a unit for transverse sealing and intermediate cut.

The known art teaches also how to pleat longitudinally, with symmetrical configuration, the longitudinal edges of at least one of the sheets constituting the tube, whereby the sacks made therefrom will have a bellows-shaped or folded cross section.

The longitudinal welding according to the conventional art is effected in such a manner that the two sheets are caused to adhere to each other due to local melting. When the wall of a sack is subjected to traction, a weld effected as described above often leads to the rupture of the wall even with traction forces much lower than those which would have been supported by a not welded sheet, so that sheets of comparatively high thickness must be used in order to obtain strong welded joints. The greater thickness of the sheets, obviously, involves higher costs, as a result of the longer time required for the welding operations. The poor resistance of the longitudinal sealings according to the conventional art is mainly due to the fact that the force exerted by the sacked product on the welded zone is perpendicular to the zone which, therefore, is subjected exclusively to traction.

In a sack manufactured according to the conventional art, the welded edges protrude considerably from said sack and dispose themselves perpendicularly thereto, thus originating problems of space requirements, safety and outer appearance.

BRIEF DESCRIPTION OF THE DRAWINGS

The above and other problems have been solved by the method and apparatus according to the invention. The characterizing features of the invention and the advantages resulting therefrom will become apparent from the following description of some preferred embodiments, made with reference to the Figures of the accompanying drawings, in which.

DESCRIPTION OF THE PREFERRED EMBODIMENTS

Figure 1:
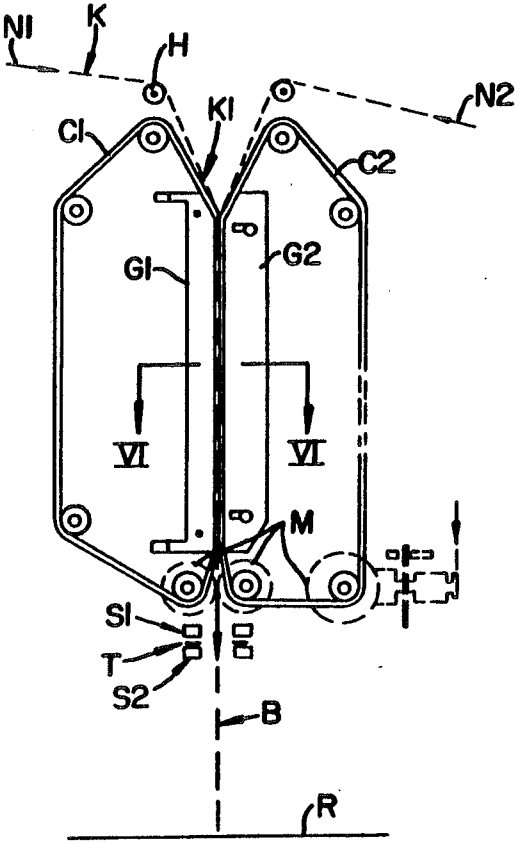
FIG. 1 is a side elevational view of a machine in which the apparatus of the invention has been incorporated.

As above mentioned, methods and apparatuses are known for manufacturing sacks made of polyethylene or other heat-weldable material in a machine for packaging loose materials, as shown in FIG. 1, starting from two films or sheets N1–N2 of the material, which are unwound from respective rolls, which sheets are superposed on each other and are conveyed with a longitudinal movement, along a vertical path of travel along which they are held at their longitudinal edges by pairs of superposed chains C1–C2 which are synchronized with each other and are powered as shown diagrammatically at M, the chains transporting downwards the tube B formed by the two sheets. G1 and G2 indicate stationary guides controlling the active runs of chains C1–C2 to oblige them to firmly clamp the edges of said sheets. Usually, the chains are advanced intermittently, and during the dwell period the superposed portions of the two sheets, which are disposed outside of said chains, will be engaged by pairs of rectilinear, parallel and opposite welders (not shown) which effect longitudinal and continuous welds on said sheets to sealingly join them. Therefore, a continuous tube B exits from the lower portion of the pairs of chains and is then closed by a dual unit for transverse welding and intermediate cut indicated at S1-T-S2. After the bottom has been closed, the tube is advanced so as to engage a conveyor R, whereafter the chains are stopped and while the longitudinal welders are operated and the unit S1-T-S2 is opened, a hopper (not shown) discharges a suitable amount of product into the tube, whereafter the unit S1-T-S2 is operated to close the filled sack, to separate it from the tube and to close the bottom of the tube. The filled sack is then moved away by the conveyor R and the cycle is repeated.

The known art teaches also how to pleat longitudinally, with symmetrical configuration, the longitudinal edges of at least one of the sheets constituting the tube, whereby the sacks made therefrom will have a bellows-shaped or folding cross section, this condition giving the sack a shape which is very similar to that of a parallelepiped when filled with a product, closed and lying horizontally lengthwise. This configuration renders the sack better stackable and palletizable.

Figure 2:
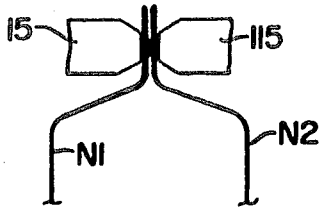
Fig. 2 (PRIOR ART)
FIGS. 2 and 3 diagrammatically show the execution of longitudinal welds according to the conventional art.
Figure 3:
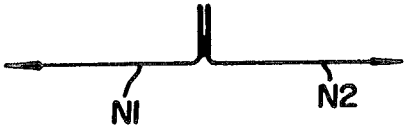
Fig. 3 (PRIOR ART)

The longitudinal weld according to the conventional art is effected in such a manner that the two thermoplastic sheets N1–N2 are caused to adhere to each other in the condition of FIG. 2, by pairs of opposite welding bars 15–115. When the wall of a sack is subjected to traction, as from FIG. 3, a weld effected as described above often leads to the rupture of the wall even with traction forces much lower than those which would have been supported by a not welded sheet, whereby sheets of comparatively high thickness must be used in order to obtain on them particularly strong welded joints. The greater thickness of the sheets, obviously, involves higher costs, as a result of the longer time required for the welding operations, both in the heating step and in the successive cooling step. The poor resistance of the longitudinal welds carried out according to the conventional art is mainly due to the fact that the force exerted by the sacked product on the welded zone is perpendicular to the zone which, therefore, is subjected exclusively to traction.

In a sack manufactured according to the conventional art, the welded edges protrude considerably from said sack and dispose themselves perpendicularly thereto, thus originating problems of space requirements, safety and outer appearance.

It has been considered that all these problems could be eliminated if the longitudinal edges of the sheet were superposed on each other, so that the inner face of an edge is superposed to the outer face of the other edge, as effected, for example, in other manufacturing machines in which sacks are formed by "tubularization" of a single sheet of plastics material which, in this instance, is provided with a single longitudinal weld. Due to many reasons which need not be considered here, the welding technology of the presently-used single-sheet machines cannot be used in the two-sheet machines of the type concerned herein.

According to the invention, it is required firstly to pre-arrange one of the two sheets to be folded over at its longitudinal edges, to enable the type of overlapping described above. The problem has been solved by effecting the folding, preferably, before the sheet is clamped by the pairs of transporting chains C1–C2 and, preferably, upstream of a turnround roller, so that by maintaining a suitable longitudinal tension of the sheet, the latter will maintain the fold that has been imparted thereto by resting on the roller and because it is so obliged by the transverse weld which at the other end thereof closes the bottom of the tube formed by said two sheets. A further problem was to find the simplest and most reliable solution to limit the welding only to the two overlapped edges of the two sheets. To solve this problem, theoretically, one of the two longitudinal welders should have been introduced into the tube formed by the two sleeves, but this solution was immediately discarded due to lack of space and due to the impossibility to fixedly fasten the welder to a supporting structure so that it can contrast the thrust exerted by the other welder. The problem has been solved in this manner: only one of the two welding bars is kept active, that is the one acting against the not-folded edge of one of the two sheets, while the other welder is replaced by a simple contrasting bar. In order to prevent the welding from affecting the inner and adjacent regions of the sheet forming the sack, there is effected the insertion, between the sheet portion which is not to be welded and the other two portions which are to be welded together, of at least one thin plate or strip of any suitable material, even of composite type, acting as a heat-insulating insert. The insert strips are supported at their upper ends by a respective support arranged upstream of the point where the two sheets overlap each other and are pinched between the pairs of chains C1–C2 for the formation of the tube.

Figure 4:
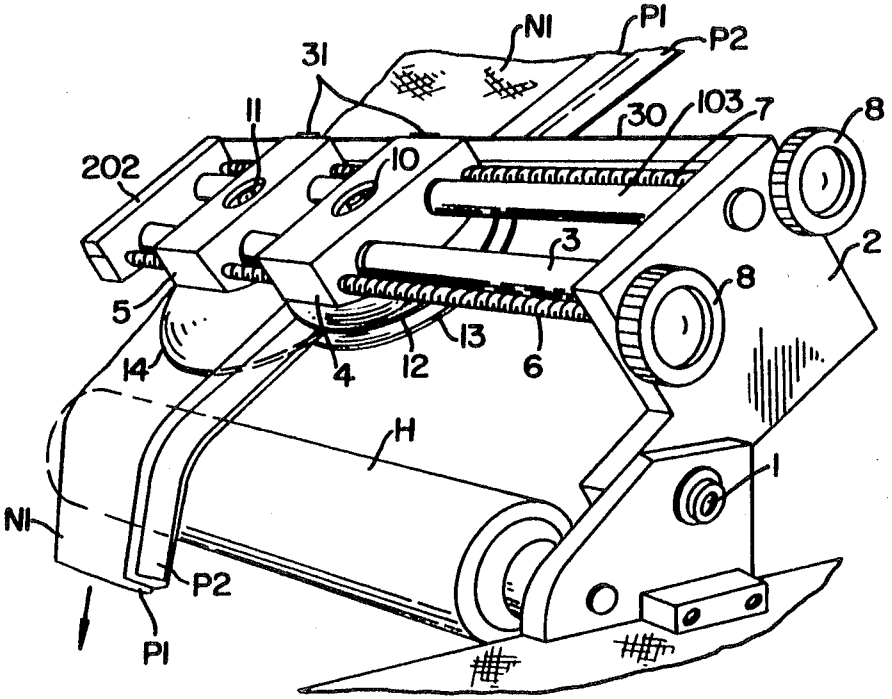
FIG. 4 is a perspective view of one of the units for folding the longitudinal edges of one of the sack-forming sheets.
Figure 8:
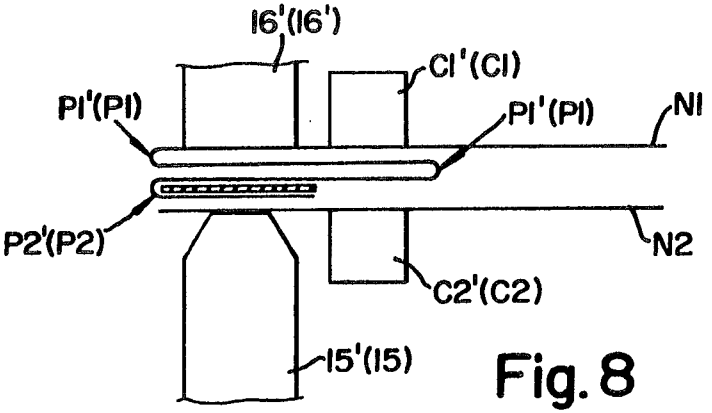
FIGS. 8 and 9 show, similarly to the sectional view of FIG. 6, as many different configurations of the longitudinal edges of the sack-forming sheets.
Figure 5:
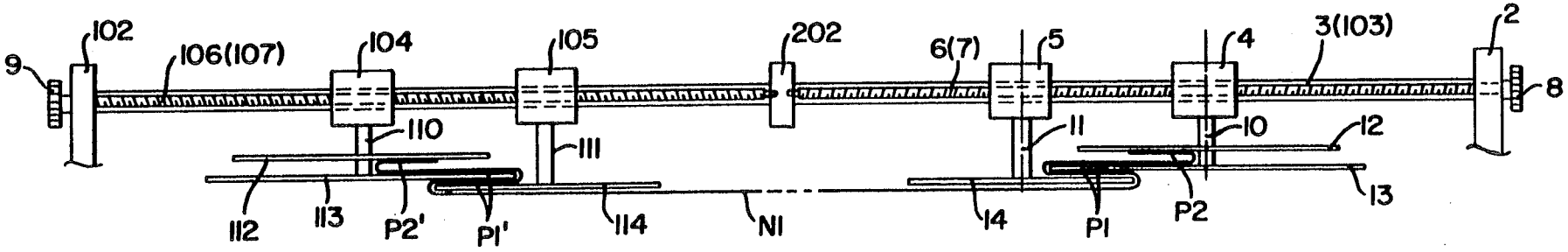
FIG. 5 is a front elevational view of the unit of FIG. 4.

As stated above, the method according to the invention, comprises the requirement of folding in a reentrant manner the longitudinal edges of at least one of the two sack-forming sheets, so that these edges will contact the inner face of the other sheet, with a portion of their outer face. According to the invention, the folding is effected, for example, on the sheet N1, preferably at the point indicated by the arrow K in FIG. 1, before the sheet comes within the reach of the pairs of transporting chains C1–C2 and upstream of the turnround roller H. With reference to FIGS. 4 and 5, secured at 1 on the side frames of the machine, there are the plates 2–102 supporting, crosswise to the sheet N1 and at a suitable distance therefrom, a pair of rods 3–103 having a cross member 202 secured intermediately. Mounted on the rods, at both sides of the intermediate cross member 202, there are pairs of slides 4–5 and 104–105 whose positioning may be adjusted by means of respective screws 6–7 and 106–107. Screws 607 and 106–107 are rotatably supported by the plates and cross member, parallelly to the rods 2–102, co-operating with nut members arranged in the respective slides, passing freely through a hole formed in the slide, and selectively controlled by means of knobs 8 and 9. The positioning of the slides with respect to the intermediate longitudinal axis of the sheet N1, which coincides with the cross member 202, may be ascertained by means of graduated scales 30 fixed to the supporting members 2–102–202, parallel to the rods 3–103 and co-operating with reference pointers 31 (see FIG. 4) on the slides. Rotatably mounted on the slides there are respective shafts 10–11, 110–11 extending downwards perpendicularly to the sheet N1 and having mounted thereon discs 12–13–14 and 112–113–114 acting on the edges of the sheet to suitably fold them. The discs 13–14 and 113–114 effect the S-shaped folds at the edges of the sheet, indicated by P1 and P1', which are necessary for the bellows-shaping of the sack-forming tube. The discs 12–13, 112–113 and the shafts 10–110 form the channels required to form the folds P2–P2' which make the sheet N1 overlap the inner face of the sheet N2, through portions of its outer face. During the vertical path of travel when the two sheets are held by the pair of chains C1–C2 and C1'–C2', the two sheets are, in fact, in the condition shown in FIG. 6. Otherwise, the folds P1–P1' may be such as to overlap, with a portion thereof, the portions P2–P2', as shown for example in FIG. 8, so that the edges of the sack-forming tube will have no projections, contrarily to the example of FIG. 6. This condition may be obtained easily by acting on the adjusting screws for the folding discs acting on the sheet N1.

It appears from FIGS. 1 and 4 that, because of longitudinal tensioning exerted on both sheets by the transporting chains and by the tensioning means which control them after being unwound from the respective rolls, and because of the supporting action of the roller H and the fastening action of the transverse bottom weld of the tube effected by the unit S1, the sheet N1 will be maintained steadily in the folded condition to which it is brought by the device of FIG. 4.

In order to ensure that the sheet N1 has a proper shaping of its edges when it reaches the longitudinal and transverse welding units, the folds P1–P1' may be fastened by means of spot welds. These welds can be effected, for example, by perforating the folds by means of heated point elements at such a rate that spots will result on the portion of the tube that is included between the areas to be engaged by the transverse welding members S1–S2, thereby avoiding compromising the tightness of the sacks.

The longitudinal welds of the sheets N1 and N2 are effected only by the welding bars 15–15' which act by directly engaging the edges of the sheet that is not provided with the folds P2–P2', while the opposite bars 16–16' are not heated and may be secured to the frame of the machine. The bars 16–16' are now used only as contrasting means for the welding bars 15–15' which are the only members which are heated, as indicated at 17–17', and moved with a rectilinear, horizontal, reciprocating movement, as indicated by the arrows 18–18' in the same FIG. 6. The contrasting members 16–16' need not coated with Teflon® (Dupont's trademark for tetra-fluoroethylene fluorocarbon polymers) as the welding bars are, because they act on the sheets for dissipating the heat which is emitted by the bars 15–15'. For this purpose, the contrasting members may be suitably cooled by appropriate means.

Figure 12:
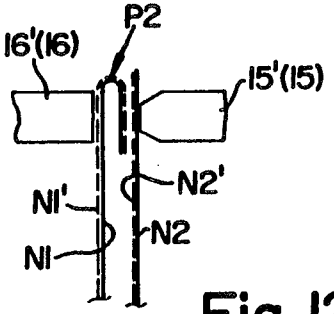
FIGS. 10, 11 and 12 show, similarly to the sectional views of FIGS. 6, 8 and 9, various ways to carry out the method of the invention.

By using co-extruded thermoplastics or other composite sheets, as shown in the example of FIG. 12 where N1 and N2 indicate high-density layers and N1'–N2' indicate low-density layers which due to the folds P2–P2' overlap at the weld areas, it is possible to achieve the objective of limiting the welding only to the overlapped edges of the two sheets, thereby avoiding the superposed portions of the same sheet N1.

Figure 7:
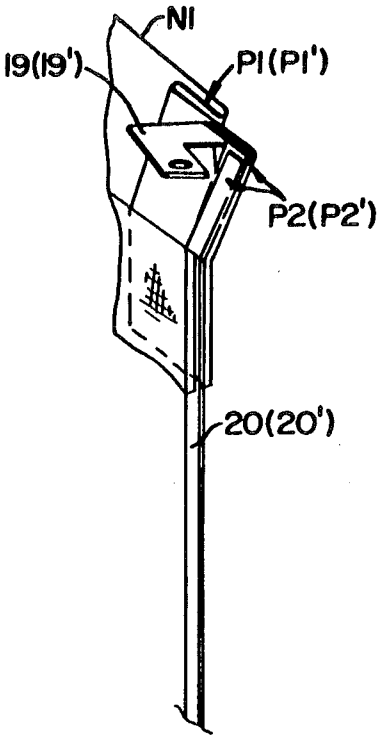
FIG. 7 is a perspective view of a possible embodiment of one of the heat-insulating strips inserted in the longitudinal edges of one of the two sack-forming sheets.

According to a preferred embodiment of the invention, at the point of the edges of the sheet N1, indicated by the arrow K1 in FIG. 1, when the edges are not yet coupled with those of the sheet N2, there may be provided supports 19–19' of the type shown in FIG. 7, which are secured by one end to the frame of the machine and which overhangingly support the upper portion of inserts having the form of flexible strips 20–20' which are accommodated in the folds P2–P2' and which are of such a length as to reach the longitudinal welding elements 15–15' and, preferably, to extend beyond them for a suitable length without interfering with the transverse welding and cutting unit S1-S2-T. The insert strips 20, 20' are intended to be interposed between the pair of superposed sheet edges to be welded together, in order to concentrate onto them the heat from the bars 15–15' and to prevent the heat from reaching the outer portion of the fold P2 with obvious consequences.

The insert strips 20–20' are confined between the outer edge of the respective folds P2–P2' and the pairs of sheet-transporting chains, so that they are maintained suitably in their correct position even if they are only anchored at one end from the supports 19–19' and even if they are relatively flexible. A sufficient flexibility, on the other hand, is desirable and necessary to uniformly distribute the pressure exerted by the welding units on the sheet portions which are to be welded together.

Good results have been obtained by using strips 20–20' made of stainless steel, with suitably rounded edges and a thickness of a few millimeters. However, it is to be understood that the strips may be made of any other suitable material. Preferably the material used for the strips is made of a material that does not adhere to the welded edges of the sheets.

Figure 9:
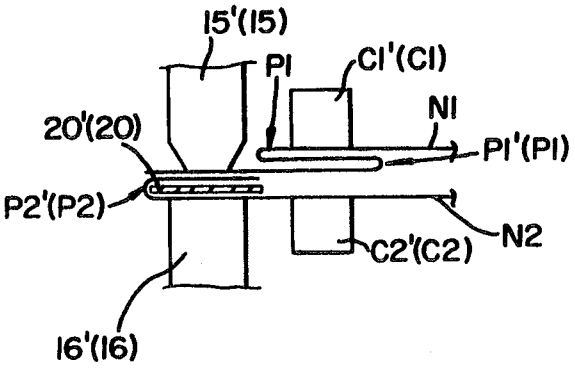

FIG. 9 shows that according to a modification in the execution of the welding method disclosed above, the folds P2–P2' may be at the edges of the sheet N2, while the edges of the sheet N1 are only provided with the bellows-shaped folds P1–P1'. In this case, the welding bars 15–15' will act against the edges of the sheet N1, while the contrasting members 16–16' will concern the sheet N2.

Figure 10:
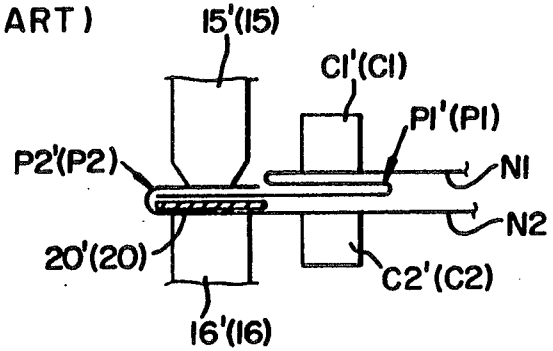

According to a modification in the execution of the method disclosed above, shown in FIG. 10, the formation of the folds P2–P2' may be effected on the edges of one of the two sheets, e.g. the sheet N2, when said sheets are already clamped between the pairs of transporting chains and are superposed to each other. The edges to be folded of the sheet N2 protrude beyond the other sheet N1 and are folded thereover by any suitable stationary or movable means. In the present case, the strips 20, 20' are placed between two edges to be welded together and the sheet N2 from which the folds P2–P2' are originated. The welding bars 15–15', in this instance, operate on the folded over edges, while the contrasting members 16–16' act on the sheet N2 whose edges have been folded over.

Figure 11:
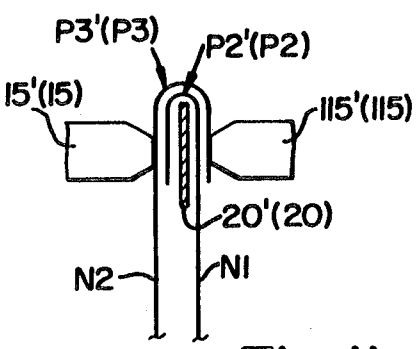
Figure 6:
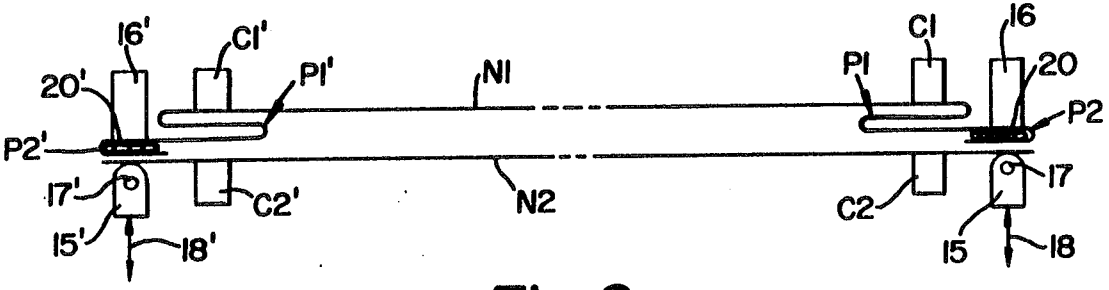
FIG. 6 is a diagrammatic sectional view on the line IV—IV of FIG. 1, showing the configuration and mutual arrangement of the two sack-forming sheets.

FIG. 11 shows a modification utilizing the combination of the solutions of FIGS. 6 and 10. The sheet N1 is provided with the above mentioned folds P2–P2', effected upstream of the transporting chains, while the edges of the sheet N2 are folded over P2–P2', as indicated at P3–P3', when the sheets have already been clamped by the transporting chains. In this case, the superposed edges of the two sheets are submitted to pairs of opposite welds by corresponding pairs of welding bars 15–15' and 115–115'. The double weld ensures a junction even more resistant of the sheets N1 and N2.

I claim:

1. An apparatus for manufacturing sacks by effecting longitudinal welds on two superposed sheets of heat-weldable material, to form a tube from which sacks are obtained by successive transverse welding and cutting operations, comprising:

two pairs of sheet-transporting chains;

means for folding longitudinal edges of at least one of two opposing sheets to form folded edges so that outer faces of said edges are directed towards inner faces of edges of the opposing sheet when said sheets are superposed on each other between said two pairs of chains which clamp said sheets and advance said sheets longitudinally, said superposed sheets comprising a sack forming tube;

insert strips supported at upper ends thereof by stationary supporting means arranged upstream of where said two sheets are superposed on each other to form said tube, said insert strips being inserted inside said folded edges so as to prevent said folded edges from being welded to the sheet from which said portions are originated; and welding bars acting on non-folded edges of one of the two sheets, while contrasting members act in opposition to said bars.

2. An apparatus according to claim 1, in which said insert strips are flexible to permit a uniformly-distributed compression of sheet portions interposed between the welding bars and the respective contrasting members.

3. An apparatus according to claim 1, in which said insert strips are made of a material which does not adhere to welded edges of said two sheets.

* * * * *